US010625483B2

(12) United States Patent
Capoia

(10) Patent No.: US 10,625,483 B2
(45) Date of Patent: Apr. 21, 2020

(54) CREASING DEVICE AND CORRESPONDING METHOD

(71) Applicant: Giuseppe Capoia, Cimadolmo (IT)

(72) Inventor: Giuseppe Capoia, Cimadolmo (IT)

( * ) Notice: Subject to any disclaimer, the term of this patent is extended or adjusted under 35 U.S.C. 154(b) by 219 days.

(21) Appl. No.: 15/870,280

(22) Filed: Jan. 12, 2018

(65) Prior Publication Data

US 2019/0168478 A1 Jun. 6, 2019

Related U.S. Application Data

(63) Continuation-in-part of application No. 14/008,834, filed as application No. PCT/IB2012/000638 on Mar. 30, 2012, now abandoned.

(30) Foreign Application Priority Data

Mar. 30, 2011 (IT) ..... UD2011A0047

(51) Int. Cl.

| | |
|---|---|
| ***B31B 50/25*** | (2017.01) |
| ***B31B 50/04*** | (2017.01) |
| ***B31B 50/20*** | (2017.01) |
| ***B31F 1/10*** | (2006.01) |
| ***B26D 7/00*** | (2006.01) |
| *B31B 120/70* | (2017.01) |

(52) U.S. Cl.

CPC ..... *B31B 50/25* (2017.08); *B26D 7/00* (2013.01); *B31B 50/042* (2017.08); *B31B 50/20* (2017.08); *B31F 1/10* (2013.01); *B31B 50/256* (2017.08); *B31B 2120/70* (2017.08)

(58) Field of Classification Search

CPC ..... B65H 45/12; B31B 50/26; B31B 50/88; B31B 70/88; B31F 1/10; B31F 1/08

USPC ..... 493/58, 59, 67, 355

See application file for complete search history.

(56) References Cited

U.S. PATENT DOCUMENTS

| | | | | |
|---|---|---|---|---|
| 1,060,740 | A * | 5/1913 | Cash | 493/397 |
| 1,196,956 | A * | 9/1916 | Kelleher | B31F 1/10 493/402 |
| 1,687,683 | A * | 10/1928 | Mogel | B31B 50/00 493/403 |
| 1,730,751 | A * | 10/1929 | Warrington | B31B 70/00 493/260 |
| 1,867,286 | A * | 7/1932 | Stern | B31F 1/10 493/64 |
| 1,941,484 | A * | 1/1934 | Nasmith | B26D 3/085 493/396 |

(Continued)

FOREIGN PATENT DOCUMENTS

GB 2323566 A * 9/1998 ..... B31F 1/08

*Primary Examiner* — Nathaniel C Chukwurah
*Assistant Examiner* — Lucas E. A. Palmer
(74) *Attorney, Agent, or Firm* — Themis Law

(57) ABSTRACT

A creasing device for a work unit of a machine for at least creasing and possibly cutting a sheet made of a relatively rigid material, such as corrugated cardboard for packaging, fed in a predetermined work direction, includes a first creasing member mounted rotatable with its first axis of rotation transverse to the work direction, and a pre-creasing system disposed upstream of the first creasing member in the work direction, and configured to carry out a pre-creasing which progressively deforms the material of the sheet to be worked before it is subjected to a creasing operation.

10 Claims, 3 Drawing Sheets

(56) References Cited

U.S. PATENT DOCUMENTS 1,959,424 A * 5/1934 Hawkins ..... B23D 35/008 493/353
2,022,563 A * 11/1935 Hammisch ..... B26D 3/085 493/403
2,117,220 A * 5/1938 Sieg ..... B31B 50/00 493/354
2,982,186 A * 5/1961 McKeen ..... B26F 1/28 493/362
3,147,676 A * 9/1964 Sheeran ..... B31B 50/00 493/403
3,282,175 A * 11/1966 Moser ..... B31B 50/00 493/403
3,706,251 A * 12/1972 Wheeler ..... B23D 19/02 83/456
4,776,831 A * 10/1988 Morisod ..... B31B 50/00 493/142
4,795,414 A * 1/1989 Blumle ..... B26D 3/085 493/241
5,002,524 A * 3/1991 Mills ..... B26D 1/0006 493/354
5,169,651 A * 12/1992 Heiber ..... B29C 53/06 264/284
5,804,030 A * 9/1998 Jaegers ..... B31D 3/0292 156/510
5,913,766 A * 6/1999 Reed ..... B29C 59/04 493/352
6,071,222 A * 6/2000 Schneider ..... B26D 1/245 493/355
6,508,751 B1 * 1/2003 Weishew ..... B31B 50/00 493/160
7,662,080 B2 * 2/2010 Kapturowski ..... B31F 1/10 271/2
2009/0062094 A1 * 3/2009 Inoue ..... B26D 3/14 493/60
2009/0062098 A1 * 3/2009 Inoue ..... B26D 7/2642 493/442
2012/0308334 A1 * 12/2012 Nonoshita ..... B42C 7/005 412/11

* cited by examiner

CREASING DEVICE AND CORRESPONDING METHOD

CROSS REFERENCE TO RELATED APPLICATIONS

The present application is a continuation-in-part of application Ser. No. 14/008,834 filed on Sep. 30, 2013, which is the U.S. national stage of international application no. PCT/IB2012/000638 filed on Mar. 30, 2012, which claims priority to Italian application no. UD2011A000047 filed on Mar. 30, 2011.

FIELD OF THE INVENTION

The present invention concerns a creasing device, the machine comprising said device and the corresponding creasing method, to carry out at least a creasing operation on a sheet made of a relatively rigid material, such as cardboard, plastic or materials having similar rigidity.

The present invention is preferentially but not exclusively applied to compact machines which, compared to industrial machines, have medium-low productivity and high flexibility above all in managing and working different shapes and sizes of the sheet.

In particular, with the present invention it is possible to make, with the same device, both a blind or continuous creasing and a through or segmented creasing. Here and hereafter in the description, by blind creasing we mean a shaping made with deformation through pressure on the thickness of the material, while by through creasing we mean a shaping in which at least a segment cut through on the thickness is provided.

By the term sheet, here and hereafter, we mean a single sheet, either a strip, or a roll or a reel, from which a plurality of sheets is made, having a thickness comprised between some tenths of a millimeter and some millimeters.

The present invention is preferentially applied to the working of a sheet formed by layers, typically of a corrugated form, which are glued together to define a desired thickness. An even more preferential application of the present invention, although not restrictive of the field of protection, is in the working of corrugated cardboard, with single corrugations or double or more.

BACKGROUND OF THE INVENTION

In the field of packaging, plants are known which are used to perform a plurality of creasings, or segments of preferential folding, on a packaging material, for example cardboard, so as to facilitate and guide the folding of the sheet, to define a packaging box.

In general, these plants are suitable to continuously receive a strip of the material, and are provided with creasing units able to perform on the strip transverse and longitudinal creasings distanced from each other by a determinate pitch.

The creasing units can also be suitable to cut the strip to size, to define individual sheets. The sheets correspond in size to the development of the box to be made.

Document GB 2 323 566 A describes a creasing device of a known type, to make folding grooves on both faces of a piece of cardboard.

Two types of creasing are substantially known, respectively blind or continuous, and through or segmented.

Continuous creasing provides a substantially local compression on the thickness of the material along an ideal folding line of the sheet, while segmented creasing provides to make alternating through notches, or through cut segments, along the folding line.

The choice to perform one type of creasing or the other depends on the specifications of the material, the creasing or other.

In any case, a generic creasing device is typically provided with a creasing disk that is made to rotate around an axis, which may be transverse to the direction in which the sheet to be worked is fed, and acts along the same direction of feed in order to achieve a longitudinal creasing, or to rotate around an axis parallel to the direction of feed, and acts transverse to it in order to achieve a transverse creasing.

One disadvantage of known creasing devices is found particularly in working corrugated cardboard and especially in small-size machines, that is, for small productions, but with great flexibility in working different formats.

In order to contain costs, weight and bulk, such small-size machines comprise small creasing discs. It should also be considered, however, that in industrial machines the diameter of a creasing disc can reach as much as 600/700/900/1000 mm, and therefore a very great weight, especially if multiplied by the usually large number of creasing discs that an industrial machine provides.

In small-size machines, especially when working corrugated cardboard which has the so-called ridges adjacent to each other, providing small creasing discs causes the material or ridges to "explode" along the creasing line, inasmuch as, given the same creasing force applied, the pressure is locally much greater and applied violently, instantaneously and substantially locally on the thickness of the material, that is, on the ridge. Indeed, the pressure acts on the internal chambers of the corrugated cardboard which are compressed and, depending on the thickness of the individual internal corrugated layers, resist to a greater or lesser extent against the deformation and, beyond a certain limit, cause the material that surrounds them to explode and break. The more the thickness increases, the more amplified this effect is, for example for double corrugation cardboard, and the more the thickness of the internal layers is reduced. This is so much greater in creasing operations performed transverse to the main direction of development of the corrugations or ridges. Typically, the cardboard is fed with the corrugations transverse to the work direction, also called machine direction, and hence this disadvantage mainly occurs in longitudinal creasing operations, that is, where the axis of rotation of the creasing discs is transverse to the work direction. In industrial machines, which have much bigger costs, bulk and weight, this phenomenon is limited because large creasing discs are able to perform a progressive creasing and to prevent, or at least reduce, the explosion of the material.

Purpose of the present invention is to obviate the disadvantages of the state of the art and to obtain a creasing device, and perfect a creasing method, particularly for small machines with great working flexibility, which allows to achieve a progressive working of the sheet fed, preventing the phenomenon of exploding material, especially in the case of sheets of corrugated cardboard.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other features of the invention or variants to the main inventive idea.

A creasing device according to the present invention is used in a longitudinal or transverse work unit of a machine for at least longitudinal or transverse creasing and possible cutting operations on a sheet of relatively rigid material, such as for example corrugated cardboard for packaging, fed in a determinate work direction.

The creasing device comprises a first creasing member, mounted rotatable with its first axis of rotation transverse to the work direction.

According to the present invention, the longitudinal or transverse creasing device also comprises pre-creasing means disposed upstream of the first creasing member in the work direction, and configured to perform a pre-creasing operation that progressively deforms the material of the sheet to be worked before it is subjected to creasing proper.

The present invention causes a more progressive deformation of the internal layers of the creased sheet, particularly in the case of longitudinal creasing where the corrugations are transverse to the work direction, preventing or in any case limiting the explosion of the material. This is also advantageous, however, in transverse creasing, that is, both in a direction parallel to the ridge of the corrugated cardboard, and also in a transverse direction.

The present invention simulates the bulk of a longitudinal or transverse creasing tool with a greater diameter, for example about 900 mm, typical of industrial machines, obtaining a pre-working which prepares the material for creasing proper performed by the first creasing member.

In some forms of embodiment, the pre-creasing means are configured to define a lead-in surface inclined toward the first creasing member, which progressively compresses the sheet toward the first creasing member.

In some forms of embodiment, the lead-in surface is shaped with a profile with a desired geometry, which simulates and on the whole reproduces a segment of a creasing tool of bigger sizes than those of the first creasing member, normally used in industrial machines.

In some forms of embodiment, the pre-creasing means comprise a second pre-creasing member, upstream of the first creasing member in the work direction.

In some forms of embodiment of the present invention, the first creasing member is a first creasing disc and the second pre-creasing member is a second pre-creasing disc. The first creasing disc has a larger diameter than the second pre-creasing disc and the axis of rotation of the first disc is aligned and parallel on the same plane with the axis of rotation of the second pre-creasing disc, at the same height with respect to the plane on which the sheet being worked lies.

According to some variants, a support element is provided able to pivot and support both the first creasing member and the second pre-creasing member, comprising a first portion that supports and pivots the first creasing member and a second portion, protruding or extended in the sense upstream of the first creasing member in the work direction, to support and pivot the second pre-creasing member.

In some variants, the lead-in surface connects the first creasing member to the second pre-creasing member along a trajectory suitable to achieve the desired and progressive linear compression of the material of the sheet along the segment of the lead-in surface and before the first creasing member.

The distance between the axes of rotation of the first creasing member and the second pre-creasing member, together with the ratio between the diameters of these, is correlated to the desired conformation to be obtained for the lead-in surface.

With the present invention, therefore, the lead-in surface for pre-creasing defines a desired angle of initial incidence on the material, so as to stretch the material to yield strength and beyond, and progressively deform it without causing it to break for a desired linear segment corresponding to the length of the lead-in surface. In substance, by means of the lead-in surface, the pre-creasing means perform the function of a track that acts linearly for a certain segment, with a desired angle of incidence and progressively on the material, achieving a linear pre-creasing along the whole segment from the second pre-creasing member to the first creasing member, thus preparing the material for the subsequent creasing by the first creasing member.

In the form of embodiment where the first creasing member and the second pre-creasing member are idle, a transmission element is provided, which winds around the first creasing member and the second pre-creasing member, and which rotates following its interaction with the advancing sheet. One segment of the transmission element which, gradually rotating, finds itself facing toward the sheet to be worked and comprised between the first creasing member and the second pre-creasing member, obtains the lead-in surface.

In the form of embodiment where the first creasing member and the second pre-creasing member are independently motorized, the lead-in surface is formed by an element shaped with a desired shape to determine the progressive pre-creasing effect, disposed fixed between the first creasing member and the second pre-creasing member on the side facing onto the sheet to be worked.

The present invention also concerns a method for creasing a sheet of relatively rigid material, such as corrugated cardboard for packaging, which provides to perform a pre-creasing operation that progressively deforms the material of the sheet to be worked before it is subjected to creasing proper, using pre-creasing means to define a lead-in surface inclined with respect to the sheet toward a creasing member used for creasing, the lead-in surface progressively compressing the sheet toward the creasing member, wherein the lead-in surface is shaped according to a profile with a desired geometry which simulates and on the whole reproduces a segment of a creasing tool of a larger size than that of the creasing member.

BRIEF DESCRIPTION OF THE DRAWINGS

These and other characteristics of the present invention will become apparent from the following description of a preferential form of embodiment, given as a non-restrictive example with reference to the attached drawings wherein.

To facilitate comprehension, the same reference numbers have been used, where possible, to identify identical common elements in the drawings.

DETAILED DESCRIPTION OF EMBODIMENTS OF THE INVENTION

Figure 1:
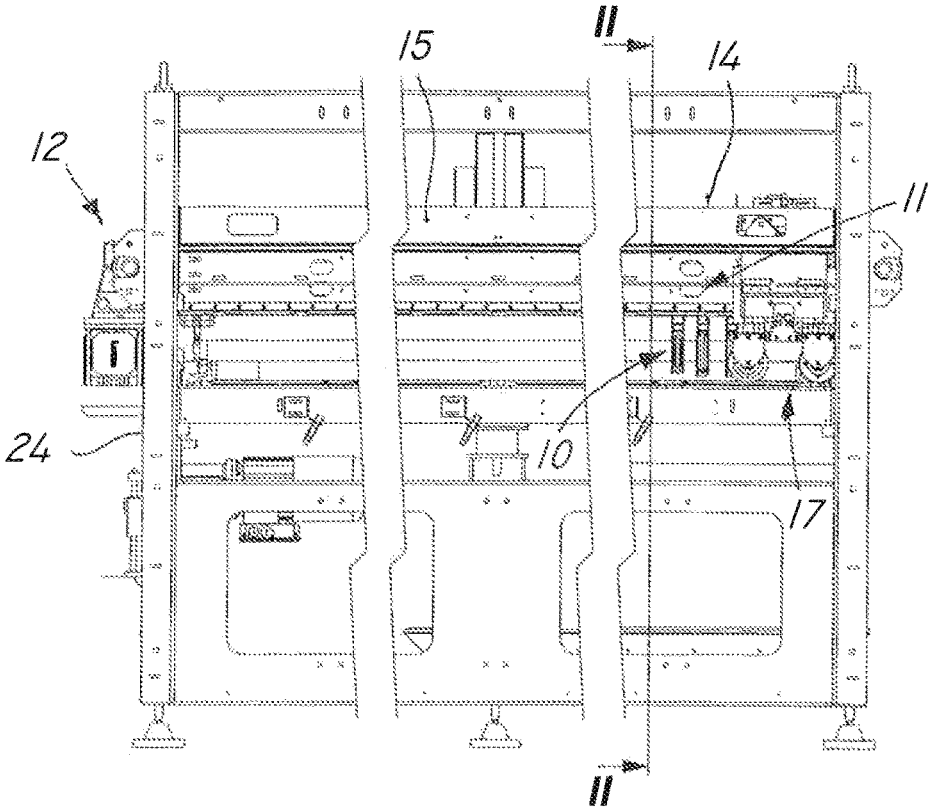
FIG. 1 is a front view of a machine according to the invention for working a sheet.
Figure 2:
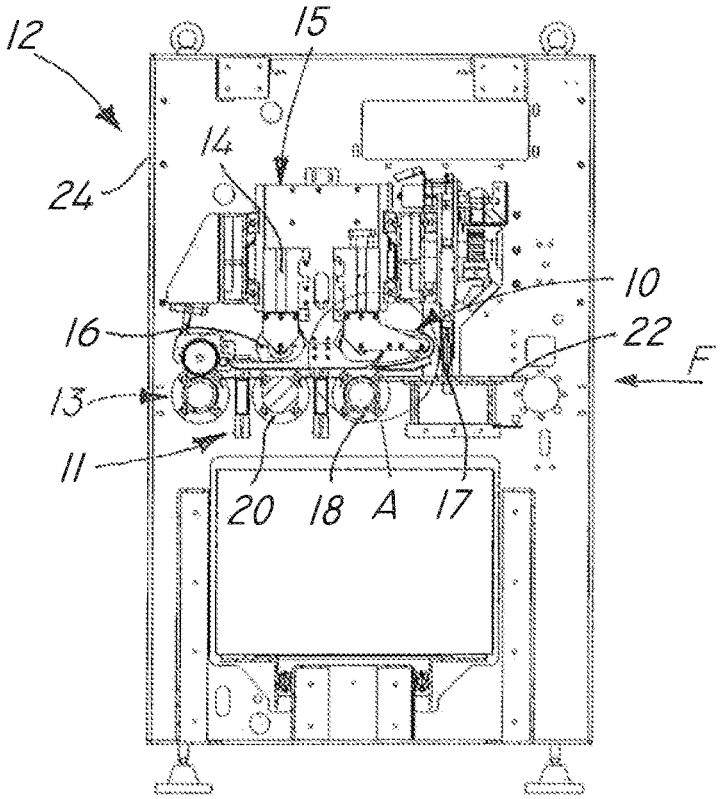
FIG. 2 is a section from II to II of FIG. 1.

With reference to the attached drawings, a creasing device 10 according to the present invention is included in a work unit 11, in this case longitudinal, of a machine 12 for at least creasing and possibly cutting a sheet of relatively rigid material, in this case corrugated cardboard for packaging, fed in determinate direction and sense of working indicated by the arrow F.

Downstream of the work unit 11, the machine 12 provides an introduction unit, not shown in the drawings, and downstream of this a unit 13 for extracting the worked sheet.

Downstream of the introduction unit a work plane 22 is provided, which cooperates with the work unit 11 disposed above it.

The work unit 11 is configured to perform the creasing and cutting of the sheet fed, in this case in a longitudinal direction, that is, parallel to the work direction F.

Upstream of the work unit 11, in the work direction F, a transverse creasing unit 17 is provided, which performs the creasing in a sense transverse to the work direction F, using the work plane 22 as a lower abutment.

The work unit 11 is mounted on a work head 14 which is selectively translatable along a girder or rail 15, disposed transverse to the work direction F and mounted on a support frame 24. In this way it is possible to vary the interaxis and reciprocal position between the working members provided in the work unit 11, so as to adapt to the various formats to be obtained.

As well as the creasing device 10, the work unit 11 in this case comprises a cutting tool 16, downstream of the creasing device 10.

Both the creasing device 10 and the cutting tool 16 are associated with corresponding contrast or abutment rolls 18, 20, disposed below them, under the work plane 22.

In general, in the illustrated form of embodiment, the cutting and/or creasing members are idle, while the corresponding contrast rolls 18, 20 are motorized, to function as drawing members. In alternative solutions, there is nothing to exclude motorizing the cutting and/or creasing members independently, and in this case the contrast rolls 18, 20 can be kept motorized in synchronized fashion, or provided idle.

The work unit 11 can also be displaced transversely to the normal lying plane of the sheet which contains the work direction F, in this case in a substantially vertical direction, so as to put the creasing device 10 and the cutting tool 16 in direct cooperation with the corresponding contrast rolls 18, 20, through suitable windows made through the work plane 22.

Figure 3:
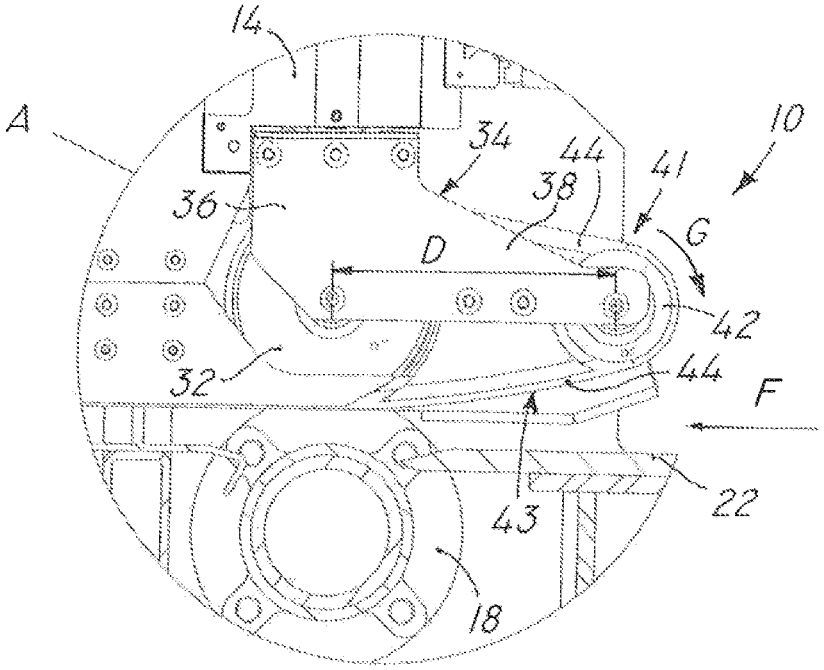
FIG. 3 is an enlarged detail of FIG. 2.

The creasing device 10, in this case suitable to perform longitudinal creasing, traditionally comprises a first creasing disc 32, mounted rotatable with its first axis of rotation transverse, in this case perpendicular, to the work direction F (FIG. 3).

In particular, a support element or flange 34 is provided, able to pivot and support the first disc 32. The support element or flange 34 is constrained and solid with the work head 14.

In this case, the first disc 32 is rotatable idly. As we said, in other forms of embodiment, the first disc 32 is independently motorized, and in this case the corresponding contrast roll 18 can be motorized or idle.

According to one feature of the present invention, the creasing device 10 also comprises pre-creasing means 41 disposed upstream of the first disc 32 in the work direction F, and configured to perform a pre-creasing operation that progressively deforms the material of the sheet to be worked before it is subjected to creasing proper, therefore preventing the material from exploding during the creasing operation.

The pre-creasing means 41 are configured to define a lead-in surface 43, inclined with respect to the work plane 22 toward the first disc 32, which progressively compresses the sheet toward the first disc 32.

For the purposes of the progressive application of the creasing force so that it is distributed better and prevents the material from exploding, the lead-in surface 43 is shaped according to a profile with a desired geometry, advantageously a curvilinear segment, preferably a circular segment, which simulates and on the whole reproduces a segment of a much larger creasing disc normally used in industrial machines, generally with a diameter that can reach as much as 900 mm, thus obtaining the desired effect as described above, but without the weight, cost and bulk of discs used in industrial machines.

The lead-in surface 43 substantially acts as a track that linearly and progressively leads in the material to be worked, with a desired angle of incidence, in practice thus achieving a linear pre-creasing.

In the form of embodiment shown, the pre-creasing means 41 comprise a second pre-creasing disc or wheel 42, upstream of the first disc 32 in the work direction F.

The second disc 42 is supported and pivoted by the same support element or flange 34 that supports and positions the first disc 32.

In particular, the support element or flange 34 comprises a first portion 36 which supports and pivots the first disc 32, and a second portion 38, lobe-shaped and protruding or extended in the sense upstream of the first disc 32 in the work direction F, to support and pivot the second disc 42.

The second disc 42 is smaller in diameter than the first disc 32, and is disposed rotatable around its own second axis of rotation parallel to the first axis of rotation of the first disc 32 and contained in a lying plane common to the first axis and parallel to the work plane 22, so that the two axes of rotation are substantially at the same height.

For example, for the purposes of comparing the sizes with creasing discs used in industrial machines with an external diameter that can reach as much as 900 mm, the first disc 32 can have an external diameter of about 100 mm, while the second disc 42 can have an external diameter of about 50 mm, therefore much smaller, less heavy and bulky, but in any case obtaining an efficient creasing operation that does not damage the material worked.

The lead-in surface 43 connects the first disc 32 to the second disc 42 along a trajectory, advantageously a segment of circumference that simulates a much bigger creasing disc, suitable to achieve the desired and progressive linear compression of the material of the sheet.

The distance D (FIG. 3) between the axes of rotation or pivoting of the first disc 32 and the second disc 42, together with the ratio between the diameters of these, is correlated to the desired conformation to be obtained for the lead-in surface 43.

In this case, the lead-in surface 43 is a segment of circumference having a radius of 450 mm and, connecting the circular surfaces of the first disc 32 and the second disc 42, thus simulates as a whole a creasing tool with sizes comparable to industrial sizes, with a diameter in this case of 900 mm, with the advantageous effects on the creasing as described above.

If the first disc 32, as we said, is idle, then the second disc 42 is also idle.

In this solution, a belt 44 or equivalent transmission element is provided, which winds around the first disc 32 and the second disc 42, and which rotates following its interaction with the advancing sheet.

The rotation of the belt 44, as indicated by arrow G in FIG. 3 in relation to the direction of feed of the sheet in the work direction F, also causes the free and synchronous rotation of the first disc 32 and the second disc 42.

A segment of the belt 44 which, gradually rotating, finds itself facing toward the sheet to be creased and hence toward the work plane 22, comprised between the first disc 32 and the second disc 42, provides the lead-in surface 43, which therefore acts as a track proper, with a desired angle of incidence in its initial segment so as to pre-crease the material of the sheet in a linear manner.

Figure 4:
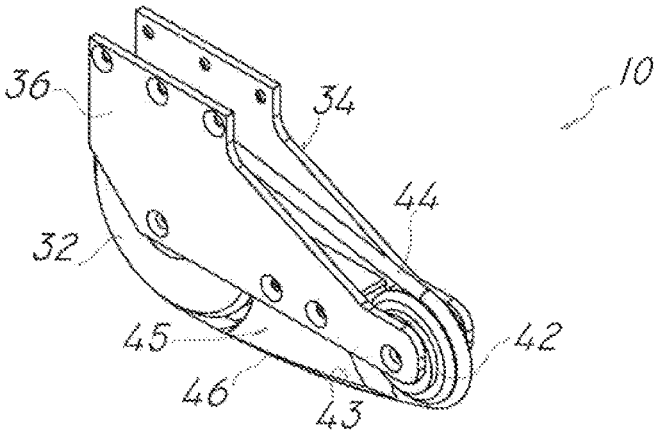
FIG. 4 depicts an intermediate member of the machine of FIG. 1.
Figure 5:
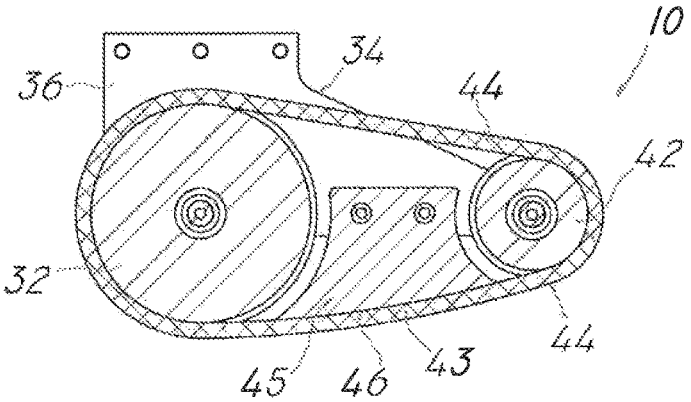
FIG. 5 depicts a cross-section of the intermediate member of FIG. 4.
Figure 6:
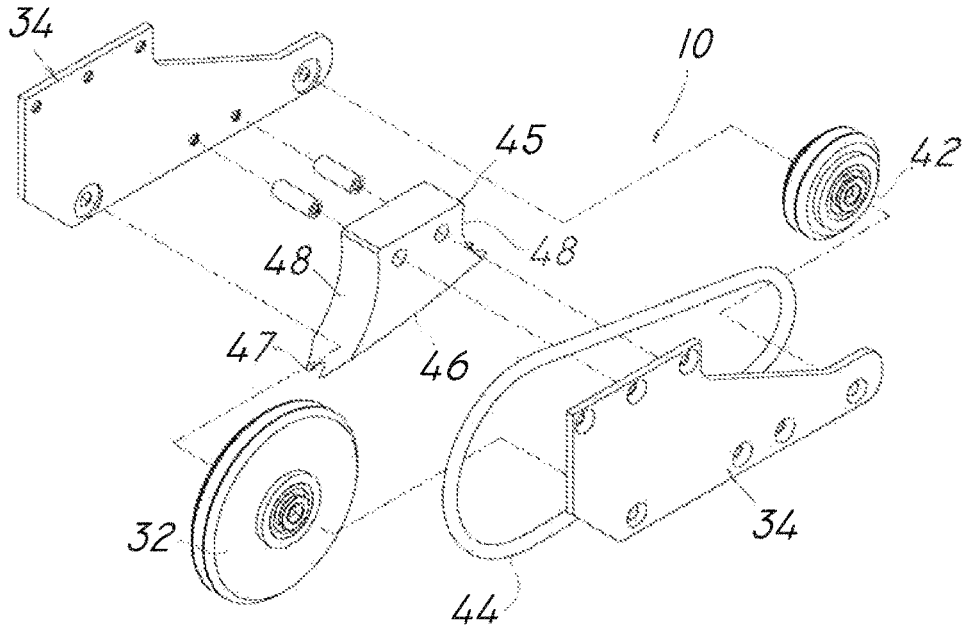
FIG. 6 depicts an exploded view of the intermediate member of FIG. 4.
Figure 7:
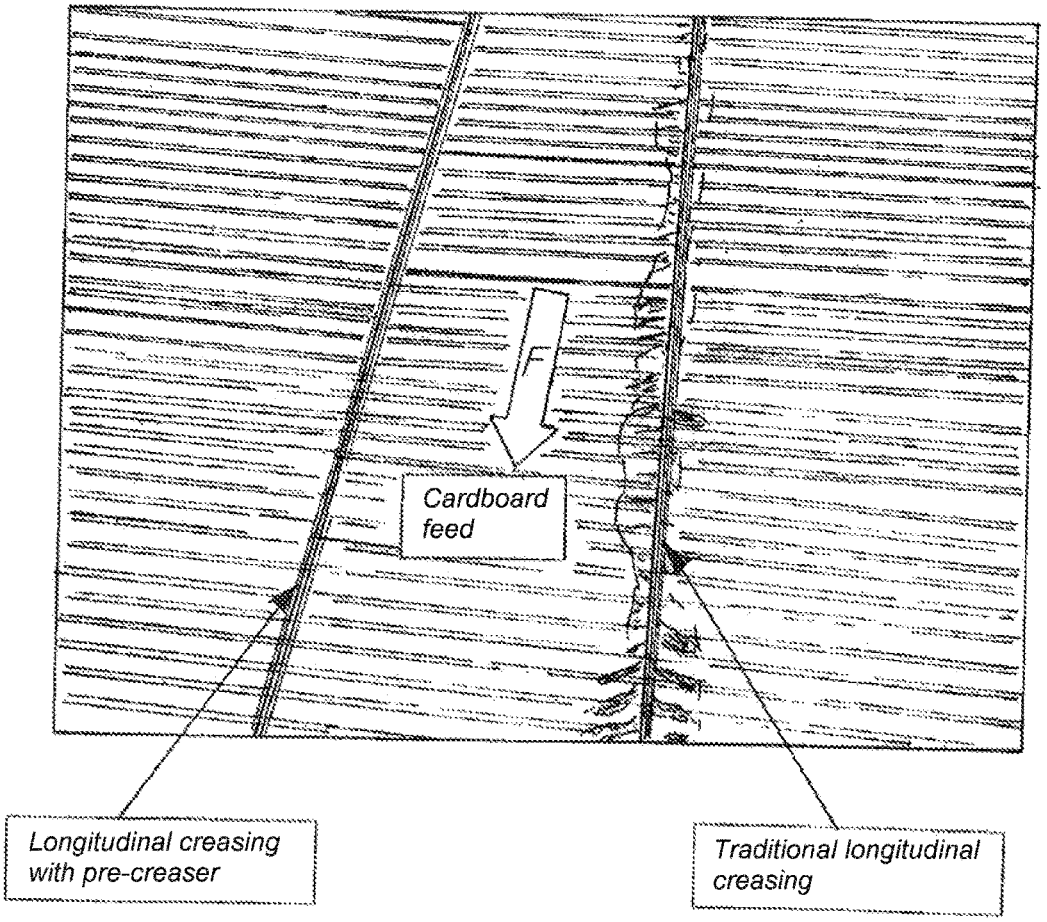
FIG. 7 shows a comparison between a traditional creasing (right) and a creasing performed according to the present invention (left).

With reference now to FIGS. 4-6, the creasing device further comprises an intermediate member 45 made of a relatively rigid material, positioned between the first creasing member 32 and the second pre-creasing member 42 and secured to the support element 34.

Such intermediate member 45 has a lower edge 46 with a circular and downwardly bulged convex profile. The lower edge 46 is provided with a groove 47 for receiving and guiding the lead-in surface 43 of the transmission element 44.

This way, the lead-in surface 43 is caused to assume a circular shape, which simulates and reproduces a segment of a creasing tool with a diameter larger than those of the first creasing member 32 and the second pre-creasing member 42 for achieving the progressive linear compression of the material of the sheet.

The intermediate member 45 has a pair of side walls 48 facing, respectively, the first disc 32 and the second disc 42. The side walls 48 are concave and each of them has a shape and a size complementary with respect to those of the first and the second disc 32, 42.

If both the first disc 32 and the second disc 42 are independently motorized, the belt 44 is not provided and the lead-in surface 43 is formed by an element shaped in a desired way to determine the progressive effect of linear pre-creasing, similar to as is described above, disposed fixed between the first disc 32 and the second disc 42 on the side facing onto the sheet to be worked and hence onto the work plane 22.

FIG. 4 clearly shows the advantageous application of the present invention for example in the longitudinal creasing of a corrugated cardboard compared with a creasing operation in the state of the art. Indeed, on the right in FIG. 4 the effects can be seen of the explosion of the creased material with traditional devices, while on the left in FIG. 4 it can be seen how pre-creasing according to the present invention preserves the integrity of the material, obtaining a precise and clean creasing. This advantageous effect is also obtained in transverse creasing, that is, both in the direction parallel to the ridge of the corrugated cardboard, and also in the transverse direction.

It is clear that, although it is described here in association with a machine 12 as shown, the creasing device 10 according to the present invention could also be applied to any other machine for making at least creasing operations on sheets of the type described, without departing from the field and scope of the present invention.

It is also clear that modifications and/or additions of parts may be made to the creasing device as described heretofore, without departing from the field and scope of the present invention.

It is also clear that, although the present invention has been described with reference to some specific examples, a person of skill in the art shall certainly be able to achieve many other equivalent forms of creasing device, having the characteristics as set forth in the claims and hence all coming within the field of protection defined thereby.

The invention claimed is:

1. A creasing device for a longitudinal work unit of a machine for creasing and cutting a sheet made of a relatively rigid material, such as corrugated cardboard for packaging, fed in a predetermined work direction, comprising:

a first creasing member mounted to be rotatable with a first axis of rotation transverse to the predetermined work direction, and a pre-creasing device having a second pre-creasing member disposed upstream of the first creasing member in the work direction, and configured to carry out a pre-creasing which progressively deforms the material of the sheet to be worked before the sheet is subjected to a creasing operation, wherein the pre-creasing device defines a lead-in surface inclined toward the first creasing member with respect to the sheet, the lead-in surface progressively compressing the sheet toward the first creasing member, wherein the lead-in surface is shaped with a profile having a desired geometry, wherein the first creasing member and the second pre-creasing member are idle, wherein a transmission element is wound around the first creasing member and the second pre-creasing member and is rotatable around the first creasing member and the second pre-creasing member following contact with the advancing sheet, wherein a segment of the transmission element, situated between the first creasing member and the second pre-creasing member and facing the sheet, provides the lead-in surface, wherein an intermediate member made of a rigid material is positioned between the first creasing member and the second pre-creasing member and has a lower edge with a circular and downwardly bulged convex profile, and wherein the lower edge of the intermediate member has a groove for receiving and guiding the transmission element in order for a surface of the transmission element providing the lead-in surface to have a circular shape which simulates and reproduces a segment of a creasing tool with a diameter larger than a diameter of the first creasing member for achieving the progressive linear compression of the material of the sheet.

2. The device as in claim 1, wherein the first creasing member is a first creasing disc and the second pre-creasing member is a second pre-creasing disc.

3. The device as in claim 2, wherein the first creasing disc has a larger diameter than the second pre-creasing disc and an axis of rotation of the first creasing disc is aligned and parallel on a same plane to an axis of rotation of the second pre-creasing disc, at a same height with respect to a lying plane of the sheet which is being worked.

4. The device as in claim 3, wherein a distance between the axes of rotation of the first creasing member and the second pre-creasing member, together with a ratio between the diameters thereof, is correlated to a desired conformation to be obtained for the lead-in surface.

5. The device as in claim 1, further comprising a support element adapted to pivot and support both the first creasing member and the second pre-creasing member, the support element comprising a first portion which supports and pivots the first creasing member and a second portion, extended upstream of the first creasing member in the work direction, in order to support and pivot the second pre-creasing member, the intermediate member being secured to the support element between the first creasing member and the second pre-creasing member.

6. The device as in claim 1, wherein the lead-in surface connects the first creasing member to the second pre-creasing member along a trajectory which achieves a desired and progressive linear compression of the material of the sheet.

7. The device as in claim 1, further comprising a guiding member for the segment of the transmission element, the guiding member causing the member to acquire a convex profile toward the sheet.

8. The device as in claim 7, wherein the convex profile has a radius of curvature of 450 mm.

9. A machine for at least creasing and cutting a sheet made of a relatively rigid material, such as corrugated cardboard for packaging, comprising:

a creasing device as in claim 1.

10. The machine as in claim 9, further comprising a cutting tool disposed downstream of the creasing device.

* * * * *